US007526917B1

(12) United States Patent
Hoffman

(10) Patent No.: US 7,526,917 B1
(45) Date of Patent: May 5, 2009

(54) GAS DIFFUSION VACUUM DEVICE

(76) Inventor: John C. Hoffman, 24 Joyce Dr., Chestnut Ridge, NY (US) 10977

( * ) Notice: Subject to any disclaimer, the term of this patent is extended or adjusted under 35 U.S.C. 154(b) by 0 days.

(21) Appl. No.: 12/189,216

(22) Filed: Aug. 11, 2008

(51) Int. Cl.
*B01D 53/00* (2006.01)

(52) U.S. Cl. ..... 60/407; 95/45

(58) Field of Classification Search ..... 60/407, 60/415; 210/321.6; 95/45; 92/79; 55/297
See application file for complete search history.

(56) References Cited

U.S. PATENT DOCUMENTS 3,595,012 A * 7/1971 Beck, Jr. ..... 60/398
4,009,585 A * 3/1977 Larin ..... 62/55.5
4,180,980 A * 1/1980 Marks et al. ..... 60/398
4,195,057 A * 3/1980 Patel ..... 422/56
5,167,698 A * 12/1992 Miyagawa et al. ..... 75/405
6,348,271 B1 2/2002 Nakata et al.
6,746,762 B1 6/2004 Hosoda et al.
6,860,993 B2 * 3/2005 Effenhauser et al. ..... 210/321.6
6,981,403 B2 * 1/2006 Ascheman et al. ..... 73/38
7,156,380 B2 * 1/2007 Soininen ..... 261/122.1

* cited by examiner

*Primary Examiner*—Thomas E Lazo
(74) *Attorney, Agent, or Firm*—Donald J. Ersler

(57) ABSTRACT

A gas diffusion vacuum device includes a supply of gas, a nonpermeable enclosure, a supply of liquid, an open liquid reservoir and a gas permeable cover. A first end of the nonpermeable enclosure is retained in the open liquid reservoir. The volume of gas is supplied through a side wall of the nonpermeable enclosure. The gas is preferably carbon dioxide. The gas permeable cover preferably includes a diffusion barrier and a porous diffusion barrier support. The diffusion barrier is wrapped over the porous diffusion barrier support and secured to a side wall of the nonpermeable enclosure. As the gas diffuses through the gas permeable cover, a vacuum is created to raise a column of liquid. A second embodiment of the gas diffusion vacuum device includes a supply of gas, a nonpermeable enclosure and a gas permeable cover. A vacuum created is used to perform work with an air driven device.

18 Claims, 2 Drawing Sheets

GAS DIFFUSION VACUUM DEVICE

BACKGROUND OF THE INVENTION

1. Field of the Invention

The present invention relates generally to diffusion of gas and more specifically to a gas diffusion vacuum device, which is used to create a vacuum that may be used to perform work.

2. Discussion of the Prior Art

It appears the prior art does not teach or suggest the diffusion of carbon dioxide gas through a permeable barrier to create a vacuum to perform work. Presently, there exists a strong interest in the production of energy through natural sources. Further, there is waste carbon dioxide gas, which is released as a by-product from some industrial processes.

U.S. Pat. No. 6,348,271 to Nakata, et al. discloses a film having gas permeability. The Nakata, et al. patent includes a drawn polypropylene film as a wrapping material that has transparency and mechanical properties sufficient as a wrapping material yet having the needed gas permeability for maintaining the freshness of the enclosed goods. U.S. Pat. No. 6,746,762 to Hosoda, et al. discloses a film selectively permeable to carbon dioxide gas and food packaging film comprising the same. The Hosoda et al. patent includes a film selectively permeable to carbon dioxide gas.

Accordingly, there is a clearly felt need in the art for a gas diffusion vacuum device, which creates a vacuum that may be used to perform work.

SUMMARY OF THE INVENTION

The present invention provides a gas diffusion vacuum device, which is used to raise a column of liquid to perform work. The gas diffusion vacuum device includes a supply of gas, a nonpermeable enclosure, a supply of liquid, an open liquid reservoir and a gas permeable cover. The open liquid reservoir is similar to a dish. A first end of the nonpermeable enclosure is retained at a bottom of the open fluid reservoir. At least one opening may be formed through a side wall at the first end of the nonpermeable enclosure to allow entrance of the volume of liquid into the nonpermeable enclosure. The gas is supplied through a side wall of the nonpermeable enclosure. The supply of gas is preferably metered through a gas control valve. The gas is preferably carbon dioxide gas. The gas permeable cover preferably includes a diffusion barrier and a porous diffusion barrier support. The porous diffusion barrier support may be secured to a top of the nonpermeable enclosure. The diffusion barrier is wrapped over the porous diffusion barrier support and secured to a top side wall of the nonpermeable enclosure. As the gas diffuses through the gas permeable cover, a vacuum is created to raise a level of the liquid in the nonpermeable enclosure. The raised liquid level has potential energy, which may be used to perform work.

A second embodiment of a gas diffusion vacuum device includes a supply of gas, a nonpermeable enclosure and a gas permeable cover. The nonpermeable enclosure includes a closed bottom and an open top. The gas is supplied through a side wall of the nonpermeable enclosure. The supply of gas is preferably metered through a gas control valve. The gas is preferably carbon dioxide gas. The gas permeable cover preferably includes the diffusion barrier and the porous diffusion barrier support. The porous diffusion barrier support may be secured to a top of the nonpermeable enclosure. The diffusion barrier is wrapped over the porous diffusion barrier support and secured to a top side wall of the nonpermeable enclosure. As the gas diffuses through the gas permeable cover, a vacuum is created. An air input valve controls the flow of atmospheric air through an air driven device and into the nonpermeable enclosure. After the vacuum has been created, the air input valve is opened and atmospheric air rushes into the nonpermeable enclosure. The atmospheric air drives the air driven device. The atmospheric air is then purged from the nonpermeable enclosure by opening an air purge valve and opening the gas control valve.

Accordingly, it is an object of the present invention to provide a gas diffusion vacuum, which creates a vacuum that may be used to perform work or to raise a column of liquid to perform work.

These and additional objects, advantages, features and benefits of the present invention will become apparent from the following specification.

DETAILED DESCRIPTION OF THE PREFERRED EMBODIMENTS

Figure 1:
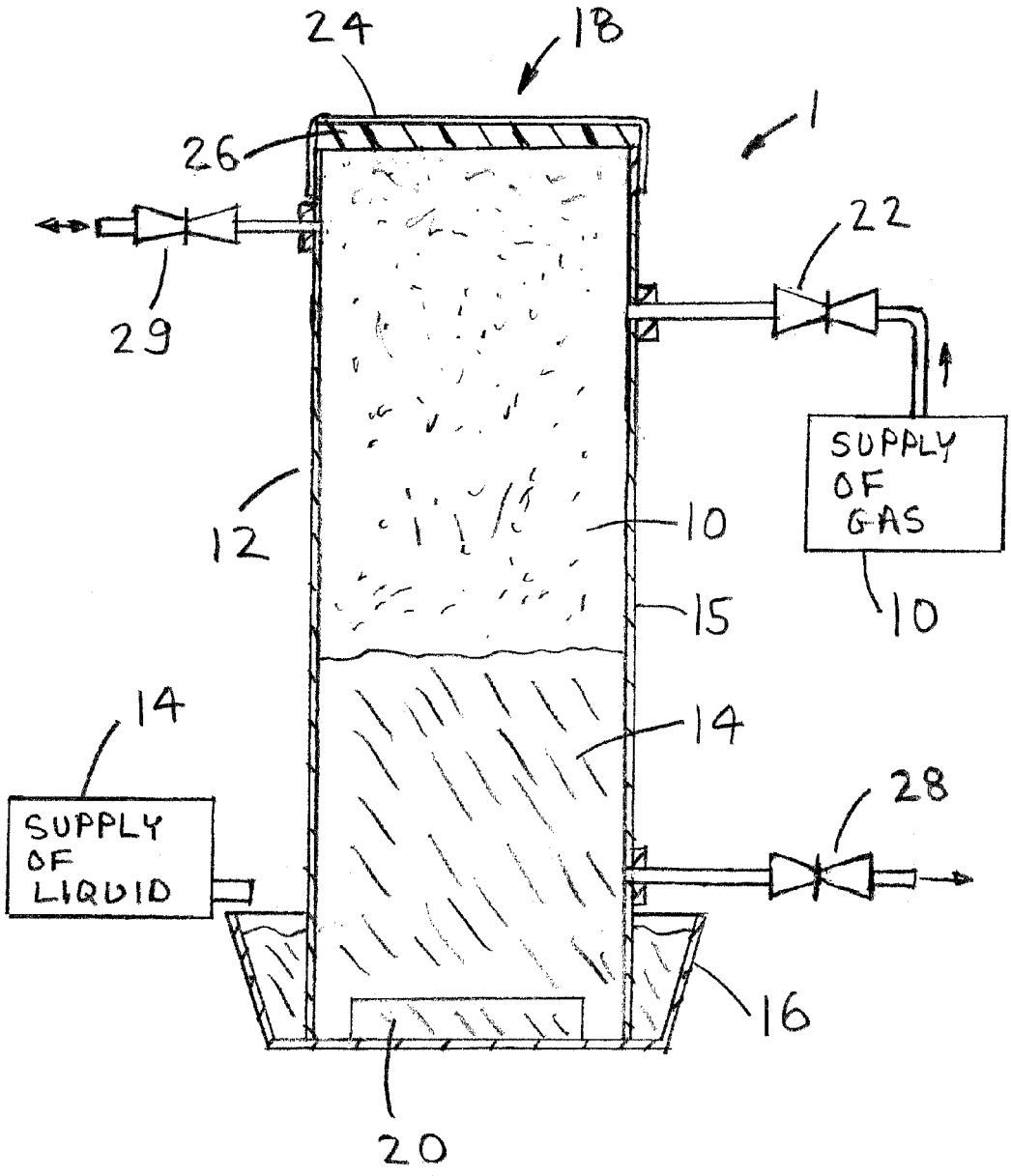
FIG. 1 is a side cross sectional view of a gas diffusion vacuum device in accordance with the present invention.
Figure 2:
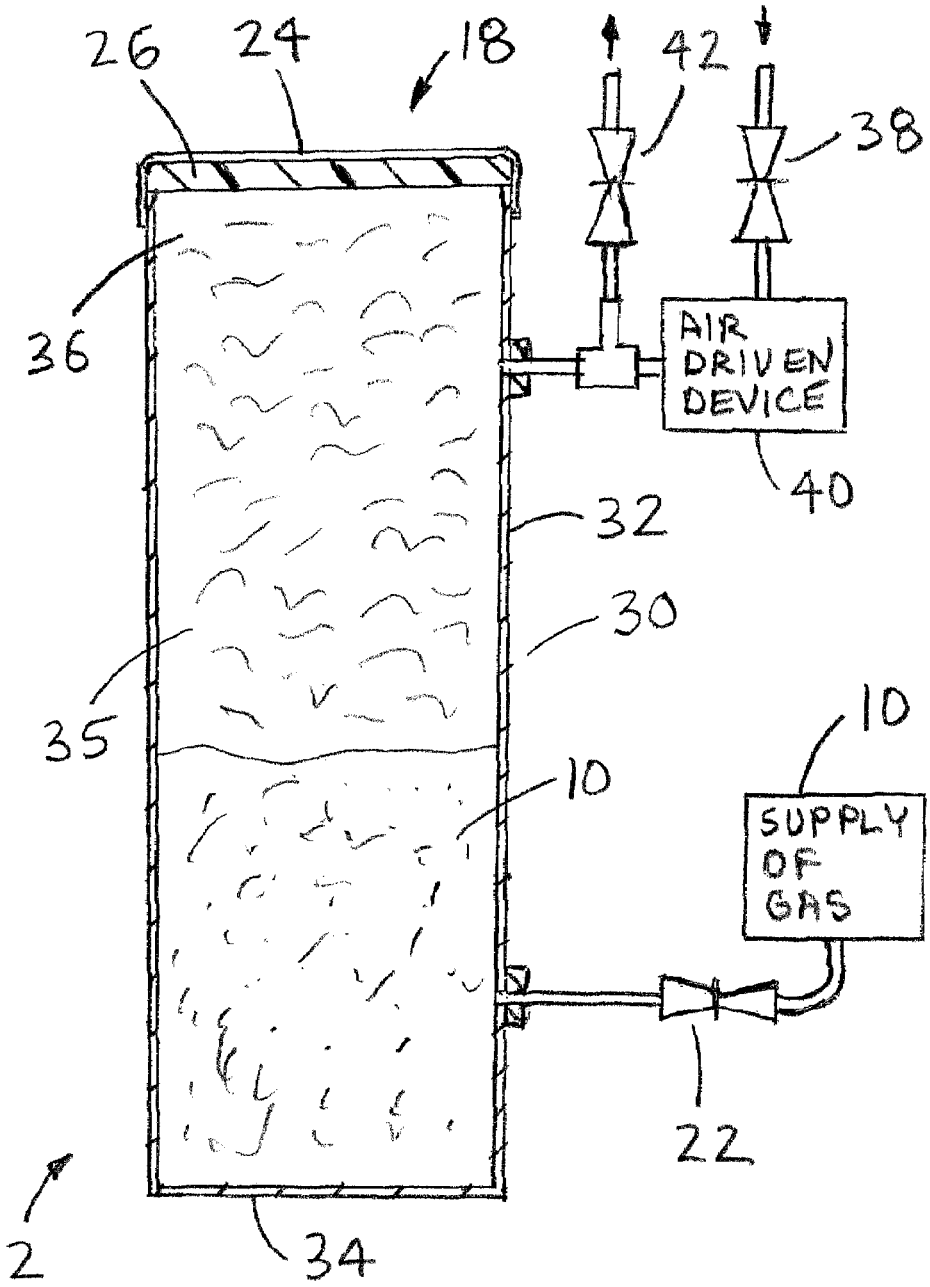
FIG. 2 is a side cross sectional view of a second embodiment of a gas diffusion vacuum device in accordance with the present invention.

With reference now to the drawings, and particularly to FIG. 1, there is shown a side cross sectional view of a gas diffusion vacuum device 1. The gas diffusion vacuum device 1 includes a supply of gas 10, a nonpermeable enclosure 12, a supply of liquid 14, an open liquid reservoir 16 and a gas permeable cover 18. The nonpermeable enclosure 12 is preferably a tube, but other types of nonpermeable enclosures may also be used. The open fluid reservoir 16 is preferably similar to a dish. A first end of the nonpermeable enclosure 12 is retained at a bottom of the open fluid reservoir 16. At least one opening 20 may be formed through a side wall 15 of the nonpermeable enclosure 12 at the first end thereof to allow the flow of the liquid 14 into the nonpermeable enclosure 12. The liquid 14 could be water, oil, mercury or any other suitable liquid.

The volume of gas 10 is preferably supplied through the side wall 15 of the nonpermeable enclosure 12. The supply of gas 10 is preferably metered through a gas control valve 22. The gas is preferably carbon dioxide gas. The gas permeable cover 18 preferably includes a diffusion barrier 24 and a porous diffusion barrier support 26. The porous diffusion barrier support 26 may be secured to a top of the nonpermeable enclosure 12. The porous diffusion barrier support 26 is preferably fabricated from a porous metal, porous ceramic, porous plastic or any other suitable rigid material. The porous diffusion barrier support 26 prevents deformation of the diffusion barrier 24 from the vacuum created inside the nonpermeable enclosure 12.

The diffusion barrier 24 is wrapped over the porous diffusion barrier support and secured around the side wall 15 of the nonpermeable enclosure 12. The diffusion barrier 24 is preferably a polyethylene film, such as that used for wrapping food containers. However, other suitable micro-porous diffusion barriers may be used, such as coatings, laminates, films and membranes. As the gas diffuses through the gas permeable cover 18, a vacuum is created inside the nonpermeable enclosure 12, which raises a level of the liquid 14 in the nonpermeable enclosure 12. The diffusion barrier 24 limits atmospheric gases from entering the nonpermeable enclosure 12.

After the level of liquid 14 has been raised by the vacuum created by the diffusion of the gas 10, the raised liquid 14 may be drained through a liquid control valve 28 to do work. A source of gas must be provided to break the vacuum inside the nonpermeable enclosure 12 to allow the raised liquid 14 to drain. The source of gas may be provided by opening the gas control valve 22 for the supply of gas 10 or an air control valve 29 may be opened to provide atmospheric air as the source of gas. The air control valve 29 is also opened to purge atmospheric air from the nonpermeable enclosure 12. Using the supply of gas 10 as the source of gas eliminates having to purge atmospheric air from the nonpermeable enclosure 12.

A second embodiment of the gas diffusion vacuum device 2 includes a supply of gas 10, a nonpermeable enclosure 30, and a gas permeable cover 18. The nonpermeable enclosure 30 includes a side wall 32, a closed bottom 34 and an open top 36. The volume of gas 10 is preferably supplied through the side wall 32 of the nonpermeable enclosure 30. The supply of gas 10 is preferably metered through the gas control valve 22. The gas 10 is preferably carbon dioxide gas. The gas permeable cover 18 preferably includes the diffusion barrier 24 and the porous diffusion barrier support 26. The porous diffusion barrier support 26 may be secured to a top of the nonpermeable enclosure 30. The diffusion barrier 24 is wrapped over the porous diffusion barrier support and secured around the side wall 32 of the nonpermeable enclosure 30.

As the gas 10 diffuses through the gas permeable cover 24, a vacuum is created. An air input valve 38 controls the flow of atmospheric air 35 through an air driven device 40 and into the nonpermeable enclosure 30. The air driven device 40 may be a turbine or any other suitable device that may be driven by the flow of atmospheric air. After the vacuum has been created, the air input valve 38 is opened and atmospheric air 35 rushes into the nonpermeable enclosure 30. The atmospheric air 35 drives the air driven device 40. The air driven device 40 causes work to be performed. The atmospheric air 35 is then purged from the nonpermeable enclosure 30 by opening an air purge valve 42 and opening the gas control valve 22. The supply of gas 10 will force the atmospheric air out of the permeable enclosure 30 through the opened air purge valve 42.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of diffusing gas to create a vacuum for performing work, comprising the steps of:

providing a nonpermeable enclosure having a first end and a second end;

filling an open liquid reservoir with a liquid, said first end of said nonpermeable enclosure being retained in said open liquid reservoir; and sealing a top of said nonpermeable enclosure with a gas permeable cover, said nonpermeable enclosure being filled with a gas, said gas diffusing through said gas permeable cover and raising a level of said liquid in said nonpermeable enclosure.

2. The method of diffusing gas to create a vacuum for performing work of claim 1, further comprising the step of:

providing said gas permeable cover with a micro-porous diffusion barrier and a porous diffusion barrier support.

3. The method of diffusing gas to create a vacuum for performing work of claim 2, further comprising the step of:

fabricating said micro-porous diffusion barrier from one of a coating, laminate, film and membrane.

4. The method of diffusing gas to create a vacuum for performing work of claim 2, further comprising the step of:

limiting the inflow of atmospheric gas into said nonpermeable enclosure with said micro-porous diffusion barrier.

5. The method of diffusing gas to create a vacuum for performing work of claim 1, further comprising the step of:

providing carbon dioxide gas for said gas.

6. The method of diffusing gas to create a vacuum for performing work of claim 1, further comprising the step of:

providing one of water, oil and mercury for said liquid.

7. The method of diffusing gas to create a vacuum for performing work of claim 1, further comprising the step of:

making said open liquid reservoir open to atmospheric pressure.

8. A method of diffusing gas to create a vacuum for performing work, comprising the steps of:

providing a nonpermeable enclosure having a closed bottom and an open top;

sealing a top of said nonpermeable enclosure with a gas permeable cover, said nonpermeable enclosure being filled with a gas, said gas diffusing through said gas permeable for creating a vacuum in said nonpermeable enclosure; and connecting an air driven device with an inside of said nonpermeable enclosure, atmospheric air entering said nonpermeable enclosure through said air driven device.

9. The method of diffusing gas to create a vacuum for performing work of claim 8, further comprising the step of:

driving said air driven device with the atmospheric air to perform work.

10. The method of diffusing gas to create a vacuum for performing work of claim 8, further comprising the step of:

providing said gas permeable cover with a micro-porous diffusion barrier and a porous diffusion barrier support.

11. The method of diffusing gas to create a vacuum for performing work of claim 10, further comprising the step of:

fabricating said micro-porous diffusion barrier from one of a coating, laminate, film and membrane.

12. The method of diffusing gas to create a vacuum for performing work of claim 10, further comprising the step of:

limiting the inflow of atmospheric air into said nonpermeable enclosure with said micro-porous diffusion barrier.

13. The method of diffusing gas to create a vacuum for performing work of claim 8, further comprising the step of:

providing carbon dioxide gas as said gas.

14. A method of diffusing gas to create a vacuum for performing work, comprising the steps of:

providing a nonpermeable enclosure having a closed bottom and an open top;

sealing a gas permeable cover sealed over said open top of said nonpermeable enclosure, said nonpermeable enclosure being filled with a gas, said gas diffusing through said gas permeable for creating a vacuum in said nonpermeable enclosure;

connecting an air driven device with an inside of said nonpermeable enclosure, atmospheric air entering said nonpermeable enclosure through said air driven device; and driving said air driven device with the atmospheric air to perform work.

15. The method of diffusing gas to create a vacuum for performing work of claim 14, further comprising the step of:

providing said gas permeable cover with a micro-porous diffusion barrier and a porous diffusion barrier support.

16. The method of diffusing gas to create a vacuum for performing work of claim 15, further comprising the step of:

fabricating said micro-porous diffusion barrier from one of a coating, laminate, film and membrane.

17. The method of diffusing gas to create a vacuum for performing work of claim 15, further comprising the step of:

limiting the inflow of atmospheric air into said nonpermeable enclosure with said micro-porous diffusion barrier.

18. The method of diffusing gas to create a vacuum for performing work of claim 14, further comprising the step of:

providing carbon dioxide gas as said gas.

* * * * *